US010066331B2

(12) United States Patent
Hendrickson et al.

(10) Patent No.: US 10,066,331 B2
(45) **Date of Patent: *Sep. 4, 2018**

(54) APPARATUS AND METHOD FOR CONTROLLING LAUNDERING CYCLE BY SENSING WASH AID CONCENTRATION

(71) Applicant: WHIRLPOOL CORPORATION, Benton Harbor, MI (US)

(72) Inventors: Michael S. Hendrickson, Owasso, OK (US); Colleen M. Doyle, Ann Arbor, MI (US); Frank Nekic, Saint Joseph, MI (US); Dennis L. Kehl, Benton Harbor, MI (US); Joel A. Luckman, Benton Harbor, MI (US); Ayomide Fawole, Festac Town (NG)

(73) Assignee: Whirlpool Corporation, Benton Harbor, MI (US)

( * ) Notice: Subject to any disclaimer, the term of this patent is extended or adjusted under 35 U.S.C. 154(b) by 7 days.

This patent is subject to a terminal disclaimer.

(21) Appl. No.: 15/338,583

(22) Filed: Oct. 31, 2016

(65) Prior Publication Data

US 2017/0044703 A1 Feb. 16, 2017

Related U.S. Application Data

(60) Continuation of application No. 13/749,057, filed on Jan. 24, 2013, which is a division of application No.
(Continued)

(51) Int. Cl.
*D06F 33/00* (2006.01)
*D06F 35/00* (2006.01)
(Continued)

(52) U.S. Cl.
CPC ..... *D06F 35/006* (2013.01); *D06F 33/02* (2013.01); *D06F 39/003* (2013.01);
(Continued)

(58) Field of Classification Search
CPC .. D06F 2202/02; D06F 2204/02; D06F 33/02; D06F 35/006; D06F 39/003;
(Continued)

(56) References Cited

U.S. PATENT DOCUMENTS 3,645,669 A 2/1972 Rausch
3,913,807 A * 10/1975 Lale ..... G01F 11/28 222/442
(Continued)

FOREIGN PATENT DOCUMENTS

DE 2501969 A1 * 7/1976 ..... A47L 15/0055
DE 3901686 A1 7/1990
(Continued)

OTHER PUBLICATIONS

German Search Report for Corresponding DE102009030287, dated Nov. 15, 2011.

*Primary Examiner* — Douglas Lee

(57) ABSTRACT

An automatic washing machine can be operated in accordance with a selected wash cycle by receiving an input indicative of a concentration of a wash aid prior to a dispensing of the wash aid into at least one of a tub and a drum, and selecting an operating parameter of the automatic washing machine in response to the determined concentration.

19 Claims, 8 Drawing Sheets

Related U.S. Application Data

12/165,984, filed on Jul. 1, 2008, now Pat. No. 8,388,695.

(51) Int. Cl.

| | |
|---|---|
| ***D06F 33/02*** | (2006.01) |
| ***D06F 39/00*** | (2006.01) |
| ***D06F 39/06*** | (2006.01) |
| ***D06F 39/02*** | (2006.01) |

(52) U.S. Cl.

CPC ..... *D06F 39/004* (2013.01); *D06F 39/005* (2013.01); *D06F 39/02* (2013.01); *D06F 39/06* (2013.01); *D06F 2202/02* (2013.01); *D06F 2204/02* (2013.01)

(58) Field of Classification Search

CPC ..... D06F 39/004; D06F 39/005; D06F 39/02; D06F 39/06

See application file for complete search history.

(56) References Cited

U.S. PATENT DOCUMENTS

| | | | | |
|---|---|---|---|---|
| 4,858,449 | A * | 8/1989 | Lehn | A47L 15/0055 134/93 |
| 4,862,711 | A | 9/1989 | Ikeda et al. | |
| 4,956,887 | A * | 9/1990 | Hakulinen | D06F 39/004 137/5 |
| 4,987,627 | A | 1/1991 | Cur et al. | |
| 5,253,379 | A | 10/1993 | Dusamos et al. | |
| 5,315,847 | A | 5/1994 | Takeda et al. | |
| 5,370,743 | A | 12/1994 | Usui et al. | |
| 5,389,344 | A | 2/1995 | Copeland et al. | |
| 5,396,316 | A | 3/1995 | Smith | |
| 5,530,531 | A | 6/1996 | Girard | |
| 5,970,273 | A | 10/1999 | Zenk et al. | |
| 6,290,346 | B1 | 9/2001 | Santhanam et al. | |
| 6,364,472 | B1 | 4/2002 | Hmelar et al. | |
| 6,463,611 | B1 | 10/2002 | Mattia et al. | |
| 6,549,276 | B1 | 4/2003 | Longtin | |
| 6,958,693 | B2 | 10/2005 | Rothgeb et al. | |
| 7,124,039 | B2 | 10/2006 | Gadini et al. | |
| 7,275,552 | B2 | 10/2007 | DeWeerd et al. | |
| 8,196,441 | B2 | 6/2012 | Hendrickson et al. | |
| 8,388,695 | B2 * | 3/2013 | Hendrickson | D06F 33/02 68/12.02 |
| 2004/0211009 | A1 * | 10/2004 | Murray | D06F 35/007 8/159 |
| 2004/0221625 | A1 | 11/2004 | Aouad | |
| 2004/0245284 | A1 * | 12/2004 | Mehus | B01F 1/0027 222/77 |
| 2006/0168740 | A1 * | 8/2006 | Ha | D06F 33/02 8/158 |
| 2006/0260065 | A1 | 11/2006 | Wright et al. | |
| 2007/0143933 | A1 | 6/2007 | Potyrailo et al. | |
| 2007/0143934 | A1 * | 6/2007 | Potyrailo | D06F 39/004 8/158 |

FOREIGN PATENT DOCUMENTS

| | | | | |
|---|---|---|---|---|
| DE | 10042713 | A1 | 3/2002 | |
| DE | 10201767 | A1 | 6/2003 | |
| EP | 0205671 | A1 | 12/1986 | |
| EP | 0379665 | A1 | 11/1989 | |
| EP | 0478888 | A1 | 4/1992 | |
| EP | 0649933 | A1 | 4/1995 | |
| EP | 0726978 | A1 | 8/1996 | |
| EP | 3911028 | A1 | 8/1996 | |
| EP | 0864684 | A1 | 9/1998 | |
| EP | 1688529 | A1 | 8/2006 | |
| EP | 1731654 | | 12/2007 | |
| EP | 1878826 | A1 | 1/2008 | |
| GB | 2052251 | A | 1/1981 | |
| GB | 2130606 | A | 6/1984 | |
| GB | 2134078 | A * | 8/1984 | A47L 15/4418 |
| JP | 3106393 | A | 5/1991 | |
| JP | 06086895 | | 3/1994 | |
| WO | 0220893 | A1 | 3/2002 | |
| WO | 2006102373 | A1 | 9/2006 | |

* cited by examiner

| Detergent | Class | Surfactant % | Refractive Index |
|---|---|---|---|
| Example 1 | 1X | 4.0 | 1.305500 |
| Example 2 | 1X | 12.0 | 1.307850 |
| Example 3 | 1X | 12.6 | 1.310960 |
| Example 4 | 1X | 14.7 | 1.310640 |
| Example 5 | 1X | 14.9 | 1.314700 |
| Example 6 | 1X | 15.5 | 1.309800 |
| Example 7 | 3X | 40.8 | 1.334500 |
| Example 8 | 3X | 46.2 | 1.359050 |

Fig. 3

APPARATUS AND METHOD FOR CONTROLLING LAUNDERING CYCLE BY SENSING WASH AID CONCENTRATION

CROSS-REFERENCE TO RELATED APPLICATIONS

This application is a continuation of U.S. patent application Ser. No. 13/749,057, filed Jan. 24, 2013, which is a divisional application of U.S. patent application Ser. No. 12/165,984 entitled "Apparatus and Method for Controlling Laundering Cycle by Sensing Wash Aid Concentration" filed Jul. 1, 2008, now U.S. Pat. No. 8,388,695, issued Mar. 5, 2013, both of which are incorporated herein by reference in their entirety.

BACKGROUND OF THE INVENTION

Conventional automatic cleaning appliances, such as washing machines, dishwashers, and the like, involve the mixing of a wash aid with water to create a wash liquid to facilitate the cleaning process. These wash aids may include detergents, water softeners, fabric softeners, whitening agents, brightening agents, in-wash stain removers, color safe bleaches, peroxygen bleaches and the like. One dispensing method is for the appropriate quantity of wash aid to be added to the cleaning appliance by an operator prior to the initiation of the laundering cycle. The operator places the wash aid in a dispenser, and the wash aid is introduced into the water at a preselected step in the cleaning cycle. The effectiveness of the wash aid is dependent, at least in part, on the quantity of wash aid dispensed. Thus, accurate measuring and dispensing of the wash aid is very desirable.

Certain wash aids, particularly laundry detergents, are increasingly supplied to the public in higher concentrations, such as twice or three times the concentration of a traditional laundry detergent. Thus, for example, if a traditional laundry detergent has a base concentration identified as "1×," a detergent having twice the concentration or triple the concentration can be identified as "2×" or "3×", respectively. Because these detergents are more highly concentrated, a smaller quantity of higher-concentration detergent is required to provide the same cleaning effectiveness as a 1× detergent.

The more highly concentrated wash aids have created a dispensing problem. Current dispensing systems are designed for wash aids of a known and standard concentration, such as the 1× detergent concentration. If a wash aid of a greater concentration is used, the dispensing system is dependent on the user to place the appropriate amount of wash aid in the dispenser. Unfortunately, reliance on the user provides a source of dispensing errors, the most likely of which is the filling of the dispensing system with too much of the higher concentration wash aid.

Conventional cleaning appliances, such as washing machines and dishwashers, require a specific amount of detergent in order to optimize cleaning and minimize the generation of excess suds, which can be detrimental to the cleaning process and certain components, particularly pumps. High concentrations of detergent can also be damaging to certain fabrics. The quantity of detergent required will be dependent on the concentration of the detergent. Thus, for example, if too large a quantity of a high-concentration detergent is dispensed, excessive sudsing can occur, or fabrics can be damaged. Conversely, if too low a quantity of a low-concentration detergent is used, soil removal from the laundered items can be less effective.

SUMMARY OF THE INVENTION

In one aspect, the disclosure relates to a method for operating an automatic washing machine in accordance with a selected wash cycle, the automatic washing machine comprising a wash chamber operable to receive fabric articles for washing, a wash aid dispenser fluidly coupled to the wash chamber, a user interface for receiving a user input indicative of an undiluted wash aid concentration, and a water supply fluidly coupled to at least one of the wash aid dispenser and the wash chamber for generating wash liquid, the method includes receiving, at the user interface, an input indicative of a concentration of the undiluted wash aid prior to combining the wash aid with a liquid, and automatically selecting an operating parameter of the automatic washing machine in response to the received input.

In another aspect, the disclosure relates to a method for operating an automatic washing machine in accordance with a selected wash cycle, the automatic washing machine comprising a wash chamber and a wash aid dispenser fluidly coupled to the wash chamber, a user interface for receiving a user input indicative of an undiluted wash aid concentration, and a water supply fluidly coupled to at least one of the wash aid dispenser and wash chamber for generating a wash liquid, the method includes receiving an input indicative of a concentration of the undiluted wash aid by way of the user interface, initiating a wash process, selecting an operating parameter of the automatic washing machine in response to the received input, initiating at least one rinse step after completion of the wash process, and initiating at least one spin process after completion of one of the wash process and at least one rinse step.

BRIEF DESCRIPTION OF THE DRAWINGS

In the drawings:

FIG. 3 is a table of the relationship between surfactant concentration and refractive index according to one embodiment of the invention.

DESCRIPTION OF AN EMBODIMENT OF THE INVENTION

The invention disclosed herein may be suitable for use in both horizontal axis and vertical axis automatic clothes washing machines, automatic dishwashing machines, and other automatic cleaning machines that utilize a selected quantity of a wash aid during a cleaning operation. The invention will be illustrated and described, however, in the context of a horizontal axis washing machine. Known horizontal axis washing machines can be characterized by two common types of washing action and water usage. The first type is known as a "tumble wash," the second type is known as a "recirculating wash."

In the tumble wash, wash liquid may be added to the tub so that the bottom of the drum and items residing in the bottom of the drum, are submerged or partially submerged. As the drum rotates, items are lifted up and dropped into the wash liquid in the bottom of the drum to create a tumbling action of the clothes to impart mechanical energy to the items to facilitate their cleaning.

In the recirculating wash, the level of wash liquid need not extend into the drum. Rather, the drum and items to be laundered are rotated while wash liquid is recirculated from the sump and sprayed on the items, typically from the top of the drum. The force of the liquid sprayed through the items facilitates their cleaning. An advantage of the recirculating wash is that less water can be used. The spraying of wash liquid on the items may be done while the drum is rotated so that centrifugal force helps draw the sprayed wash liquid through the items. The rate of rotation may be high enough that the items remain in contact with the interior of the drum and do not tumble. This speed is somewhat related to the speed at which the centrifugal force acting on the items is greater than the force of gravity.

As used in this application, the term "spin" will describe rotational speeds sufficient to plaster the items against the drum. The term "tumble" will refer to rotation speeds wherein the items are free to tumble while the drum is rotated. The term "rotate" will refer to rotation at any speed, and includes both spinning and tumbling.

In the description that follows, a specific functionality relating exclusively to either the tumble wash or the recirculating wash may be identified. Otherwise, the functionality will be considered equally applicable to both a tumble wash and a recirculating wash.

Figure 1:
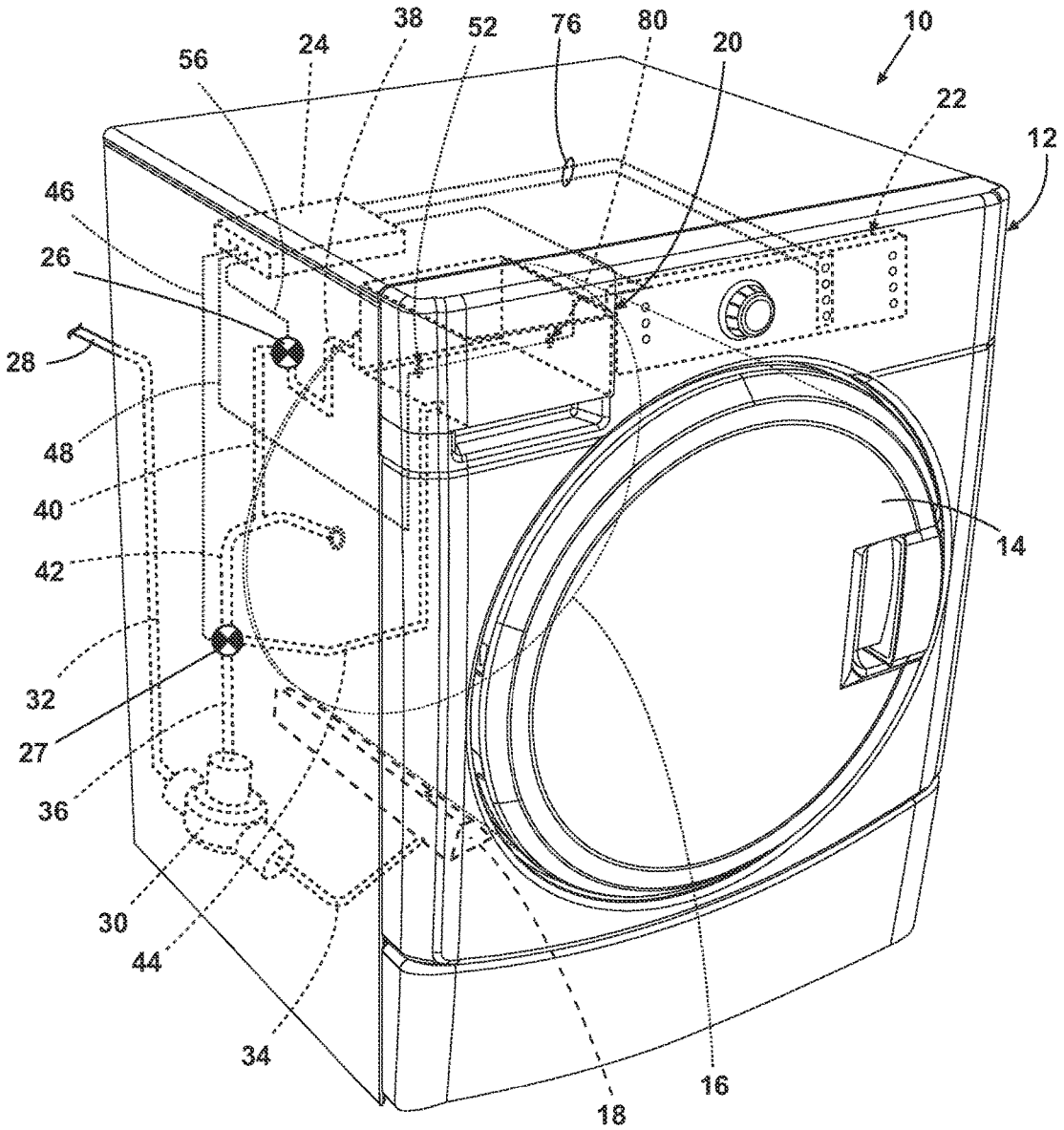
FIG. 1 is a perspective, partly schematic, view of a first embodiment of the invention as an automatic clothes washing machine having at least one concentration sensor, in the form of a refractive index sensor assembly, for determining the concentration of a wash aid.

Referring now to the drawings, and in particular to FIG. 1, a first embodiment of the invention is illustrated as a horizontal axis automatic clothes washing machine 10. The clothes washing machine 10 may include a cabinet 12 enclosing components typically found in a conventional washing machine, such as motors, pumps, fluid lines, controls, sensors, transducers, and the like. Such components will not be described further herein except as necessary for a complete understanding of the invention.

A door 14 may be provided for access to the interior a tub 16 and drum 17 (FIG. 2) suspended in the interior of the cabinet 12. The interior of the drum 17 defines a wash chamber in which the laundry items are placed for cleaning. The tub 16 may be associated with a sump 18 for carrying a liquid used during a laundering cycle. The cabinet 12 may also enclose a dispenser drawer 20 for dispensing liquid laundering aids during a laundering cycle, such as laundry detergent, fabric softener, bleach, in-wash stain removers, color-safe bleaches, peroxygen bleaches, and the like. The cabinet 12 may include a user interface 22 having operational controls such as dials, lights, switches, and displays enabling a user to input commands to a controller 24 and receive information about a specific laundering cycle. The user interface 22 may be electrically coupled with the controller 24 through user interface leads 76. The controller 24 may control a variety of operations, such as controlling a selected laundering cycle, controlling a selected modification to a selected laundering cycle, controlling pumps, motors, and sensors, terminating a laundering cycle in response to an error condition, or causing an audio or visual signal to be broadcast.

Figure 2:
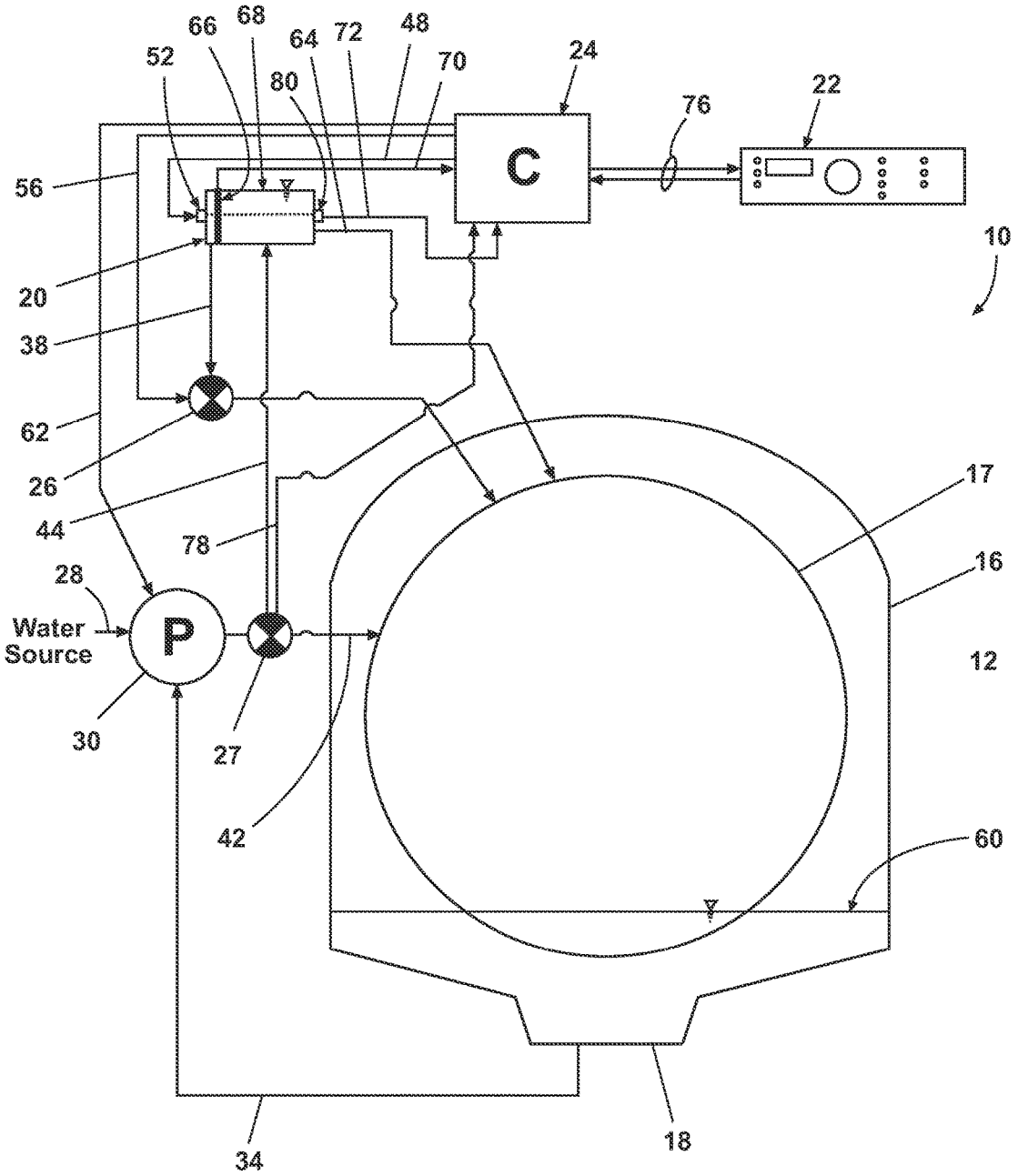
FIG. 2 is a schematic view of the automatic clothes washing machine illustrated in FIG. 1.

In the embodiment illustrated in FIGS. 1 and 2, the cabinet 12 may also enclose a pump 30 fluidly coupled with a water supply 28, and a pair of valves 26, 27. The single pump 30 is illustrated for introducing fresh water from the water supply 28 into the sump 18, the tub 16, or the dispenser drawer 20. The pump 30 is illustrated as fluidly coupled directly with the sump 18 through a sump line 34. The pump 30 is also illustrated as fluidly coupled to the valve 27 through a recirculating line 36. The valve 27 may be fluidly coupled through a recirculating line 42 with the tub 16 for recirculating wash liquid from the sump 18 to the tub 16. The valve 27 may also be fluidly coupled to the dispenser drawer 20 for delivering fresh water from the pump 30 to the dispenser drawer 20.

The dispenser drawer 20 may also be fluidly coupled through a dispensing line 38 with a valve 26, which may in turn be fluidly coupled with the tub 16 through a dispensing line 40. Fresh water may be delivered from the pump 30 through the valve 27 and the flush line 44 into the dispensing drawer 20 for flushing a laundering aid from the dispensing drawer 20 through the dispensing line 38, the valve 26, and the dispensing line 40 into the tub 16. The valve 26 may be electrically coupled with the controller 24 through a valve control lead 56. The valve 27 may be electrically coupled with the controller 24 through a valve control lead 46. The controller 24 may control the operation of the valves 26, 27 in response to instructions received from the user interface 20 as a result of selections made by the user, such as laundering cycle, water temperature, spin speed, extra rinse, and the like.

The washing machine 10 illustrated in FIGS. 1 and 2 is only one example of a washing machine configuration. It will be recognized that several pumps may be utilized for selected functions, a fewer or greater number of valves may be utilized depending upon the selected fluid line configuration and degree of control desired, and control leads may be incorporated into the device based upon the components for which control by the controller 24 may be desired.

Laundering aid sensors may be provided. For example, sensor assemblies may be used to determine the concentration of laundry detergent, either undiluted or as mixed with water to form a wash liquid. The laundering aid sensor assembly may include a dispenser sensor 80 associated with the dispenser drawer 20 for sensing the undiluted laundry detergent, and may be electrically coupled with the controller 24 through a dispenser sensor lead 48. The sensor may be a refractive index sensor, such as a Model DGWS1 liquid refractive index sensor, available from Thorlabs of Newton, N.J. While a refractive index sensor is illustrated and described, other sensors may also be used. For example, the sensor may be a resistivity sensor having a pair of electrodes in contact with the laundering aid, a pH sensor, an oxidation/reduction sensor, a chemical sensor, and the like, capable of generating a signal proportional to the concentration of the laundering aid.

As illustrated in FIG. 2, the refractive index sensor assembly may comprise a transmitter 52 and the sensor 80, whereby a beam of light may be projected through the undiluted laundering aid from the transmitter 52 onto the sensor 80, which generates a signal indicative of the concentration of the undiluted laundering aid. This signal may be delivered to the controller 24 through a dispenser sensor output lead 72.

FIG. 3 is a table illustrating the refractive index for different concentrations of detergent from different manufactures. It can be seen from the tabular data that there is a general correlation between the percentage of surfactant and the refractive index for a detergent. The refractive index tends to increase as the percentage of surfactant increases. This general correlation is strong enough that the refractive index may be used to determine between classes of concentrations, such as 1× and 3× detergents.

While the general correlation between refractive index and percent surfactant is sufficient to determine between classes, there is variation in the refractive index within a given concentration range, which is not solely attributable to the variations of the percent surfactant. These variations are thought to be attributable to other ingredients in the detergent. These variations are also partly attributable to not all classes of detergents have the same identical percentage of surfactant.

It has been noted that each detergent has a unique refractive index. In this way, the refractive index may be used as an identifier for a specific detergent. A database or table of information may be created showing the refractive index for each type of detergent. This database may be used by the controller to look up the specific detergent based on the sensed refractive index and determine the corresponding concentration.

Thus, the refractive index information may be used in at least two ways, separately or in combination, to determine the concentration of the detergent and to use that information to control the dispensing of the detergent. The first way is to use the refractive index to make a general determination regarding the class of detergent (1×, 2×, 3×, etc.). The general class determination is useful in making general distinctions, but it does not give specific information about a particular detergent's concentration. The second way is to use the refractive index to identify the detergent and look up the corresponding concentration. The look up method is useful in that the exact concentration values may be determined. For example, an advertised 1× detergent may actually have a 1.2× concentration or a 0.8× concentration.

One implementation of this method would be to first use the refractive index to identify the detergent as this will provide the most accurate results. If a match is not found, then the refractive index may be used to make a general class determination.

Figure 4:
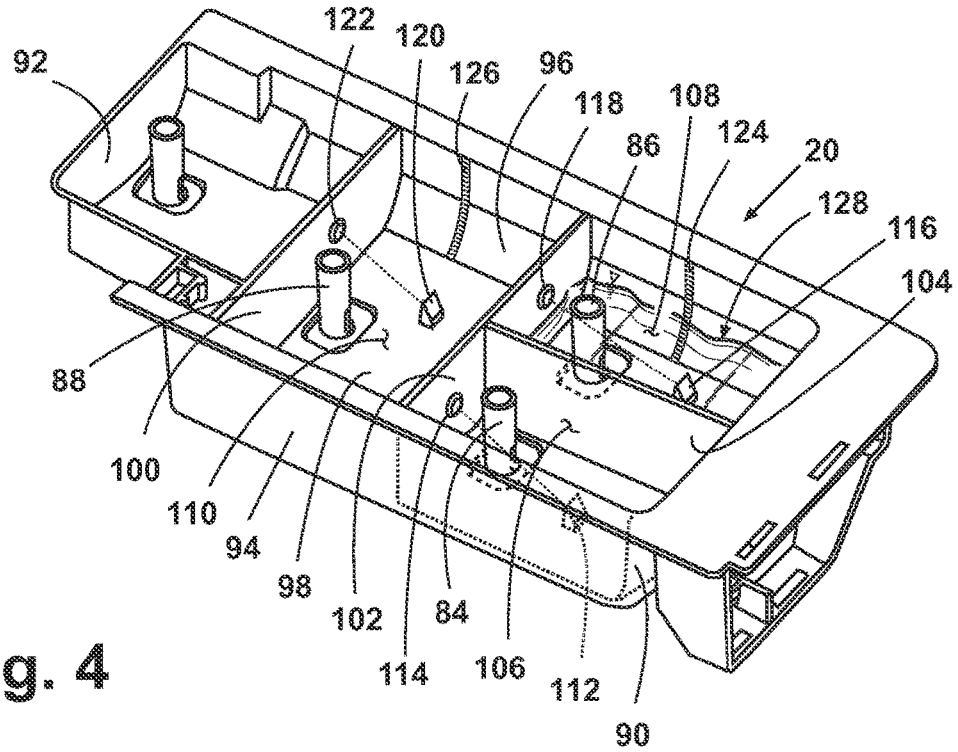
FIG. 4 is a perspective view of a first example of a wash aid dispenser drawer according to one embodiment of the invention, including at least one refractive index sensor assembly for sensing the concentration of a wash aid contained therein.

FIG. 4 illustrates an example of a dispenser drawer 20 that may be used with the washing machine 10. The dispensing drawer 20 may have a plurality of refractive index sensor assemblies for determining the concentrations of several laundering aids. The dispenser drawer 20 as illustrated has a front wall 90, a rear wall 92, a pair of sidewalls 94, 96, and a bottom wall 98. Extending laterally between the sidewalls 94, 96 may be a rear transverse wall 100 and a medial transverse wall 102. Extending longitudinally between the front wall 90 and the medial transverse wall 102 may be a longitudinal wall 104. The walls extend generally orthogonally to the bottom wall 98 and define laundering aid compartments 106, 108, 110. The laundering aid compartments may hold liquid laundering aids, such as laundry detergent, fabric softener, bleach, in-wash stain removers, color safe bleaches, peroxygen bleaches, and the like.

A first transmitter 112 and a first sensor 114 may be associated with the first laundering aid compartment 106. The first transmitter 112 may be mounted to the bottom wall 98, with the first sensor 114 mounted in the medial transverse wall 102 to receive a beam of light transmitted by the first transmitter 112 through the laundering aid in the first laundering aid compartment 106. The first transmitter 112 and first sensor 114 may be electrically coupled with the controller 24 through suitable electrical leads, such as a wiring harness, for control and processing of the input and output from the transmitter 112 and sensor 114. The first transmitter 112 and first sensor 114 may be configured so that the transmitter 112 may transmit a beam of light through the laundering aid regardless of the quantity of laundering aid in the first compartment 106. As illustrated, this configuration locates the transmitter on the bottom wall of the dispenser with it being aimed upwardly toward a receiver 122 on the side wall. Alternatively, the first transmitter 112 and first sensor 114 may be mounted in the side wall 94 and longitudinal wall 104, respectively, sufficiently near the bottom wall 98 to ensure that the light beam passes through the laundering aid. The transmitter 112 and the sensor 114 may be configured to determine when the first laundering aid compartment 106 may be empty. This may be based upon the different refractive index outputs from the sensor 114 when liquid is present in the compartment 106 and when it is not. In an alternate embodiment, the transmitter and the sensor are mounted on or adjacent to the same wall of the dispenser. This will enable the transmitter and sensor to be incorporated into a single apparatus. The light beam from the transmitter will be modulated so that it does not pass through the liquid, but is reflected internally to the sensor at the sensor-laundry aid interface. This alternate embodiment is described in greater detail hereinafter.

The second laundering aid compartment 108 may have a similarly configured transmitter 116 and sensor 118 configured for transmission of a beam of light through the laundering aid regardless of the quantity of liquid laundering aid 128 in the second compartment 108. The second compartment 108 may also be provided with a liquid height transducer 124 associated with the side wall 96 for monitoring the height of the liquid laundering aid 128 in the compartment 108. The liquid height transducer 124 may be utilized to alert the operator if the second compartment 108 is empty. In other embodiments of the invention, the liquid height transducer 124 may also be utilized to determine the volume of liquid laundering aid 128 in the compartment 108. Alternatively, the refractive index output from the sensor 118 may be utilized to determine when the compartment 108 is empty, as described above.

Each of the laundering aid compartments 106, 108, and 110 may include a dispenser siphon or suction pipe 84, 86, 88, respectively, whose top may be below the top of the corresponding compartment. To dispense the laundering aid placed in a compartment, water may be added to the selected compartment until the liquid is above the pipe, at which point the liquid may be drawn by gravity into the pipe, which initiates a siphon process for removing the liquid from the compartment. Water may be added until it is reasonably certain that substantially all of the laundering aid is dispensed from the compartment. This is referred to as "flushing" the laundering aid compartment. Other dispensing methods known to those skilled in the art may also be used to remove the laundering aid form the various laundering compartments 106, 108, 110. While not shown in FIG. 4, the suction pipes may lead to a housing that underlies the drawer 20. The housing may be fluidly connected to the dispensing line 38 such that the liquid exiting the suction pipe during flushing may be directed to the tub 16.

The third laundering aid compartment 110 may have a similarly configured transmitter 120 and sensor 122 configured for transmission of a beam of light through the laundering aid regardless of the quantity of liquid laundering aid in the third compartment 110. The third compartment 110 may be provided with a liquid height transducer 126 associated with the side wall 96 for monitoring the height of the liquid laundering aid in the compartment 110. An empty compartment 110 may also be determined from the refractive index output from the sensor 122, as described above.

Alternatively, the volume of laundering aid in a compartment may be determined from the incorporation of a weight or mass sensor into the compartment containing the laundering aid. Similarly, the control of the operation of the washing machine 10 may be correlated to the weight and concentration of the laundering aid rather than its volume and concentration.

The foregoing descriptions are of exemplary sensor locations. Other locations may be utilized for a transmitter and sensor, for example, incorporated into the valve structure 26, incorporated into the dispensing line 38, or incorporated into an auxiliary receptacle (not shown) which may be part of the dispenser drawer 20 or associated with a bulk dispenser coupling apparatus.

A first example of control of the laundering cycle will now be described with respect to the addition of a liquid laundry detergent to the second laundering aid compartment 108. Operating parameters that may be controlled may include sensing a refractive index of the laundering aid, controlling a quantity of water introduced into the automatic washing machine based on a sensed concentration of a laundering aid, controlling a flushing of the laundering aid from the laundering aid dispenser, controlling the flushing based on a sensed concentration of a laundering aid in one of the tub and the drum, maintaining the generation of suds within one of the tub and the drum below a preselected limit, adding at least one rinse step to the wash cycle, dispensing a preselected quantity of a laundering aid based on the determined concentration, halting the wash cycle, generating an audio signal, generating a visual signal, generating an error code, dispensing a quantity of a suds reducer based on the determined concentration, and the like.

In this example, a user will select a laundering cycle and will pour a selected volume of a laundry detergent into the laundering aid compartment 108. The user interface 22 may include a selector so that the user may select a concentration of laundry detergent being used, such as a 2× detergent. The controller 24 may have stored in memory a tabulation of data relating to a predetermined volume of detergent of a selected concentration for each selectable laundering cycle. Thus, for example, for a given laundering cycle, the tabulation may indicate that a first volume of a 1× detergent will be appropriate, a second volume of a 2× detergent roughly equivalent to half the first volume will be appropriate, a third volume of a 4× detergent roughly equivalent to one quarter the first volume will be appropriate, and so on.

After the user introduces the detergent into the dispenser drawer 20, the second transmitter 116 and second sensor 118 may be actuated to determine the concentration of the detergent. If the user has selected a 2× detergent on the user interface 22, the controller 24 may confirm that the proper concentration detergent, i.e. a 2× detergent, is present, and proceed with the laundering cycle. If the user has selected a 1× detergent on the user interface 22, but has introduced a 4× detergent into the dispenser drawer 20, the controller 24 may provide a responsive action. For example, the controller 24 may terminate the laundering cycle, cause an audio or visual warning signal to be broadcast, or a combination of termination and a warning signal. Alternately, the controller 24 may override the user selection and operate based on the determined concentration.

If the user mixes two laundering aids having different concentrations, e.g. 1× and 2× detergent, the controller 24 can be adapted to determine the effective concentration of the mixture, e.g. 1.37×, based upon the output from the sensor, and determine the quantity of laundering aid to dispense.

If the second laundering aid compartment 108 may be provided with a height transducer 124, the controller 24 may determine both the concentration of the detergent and the height (and thus the volume) of detergent in the laundering aid compartment 108.

Figure 5:
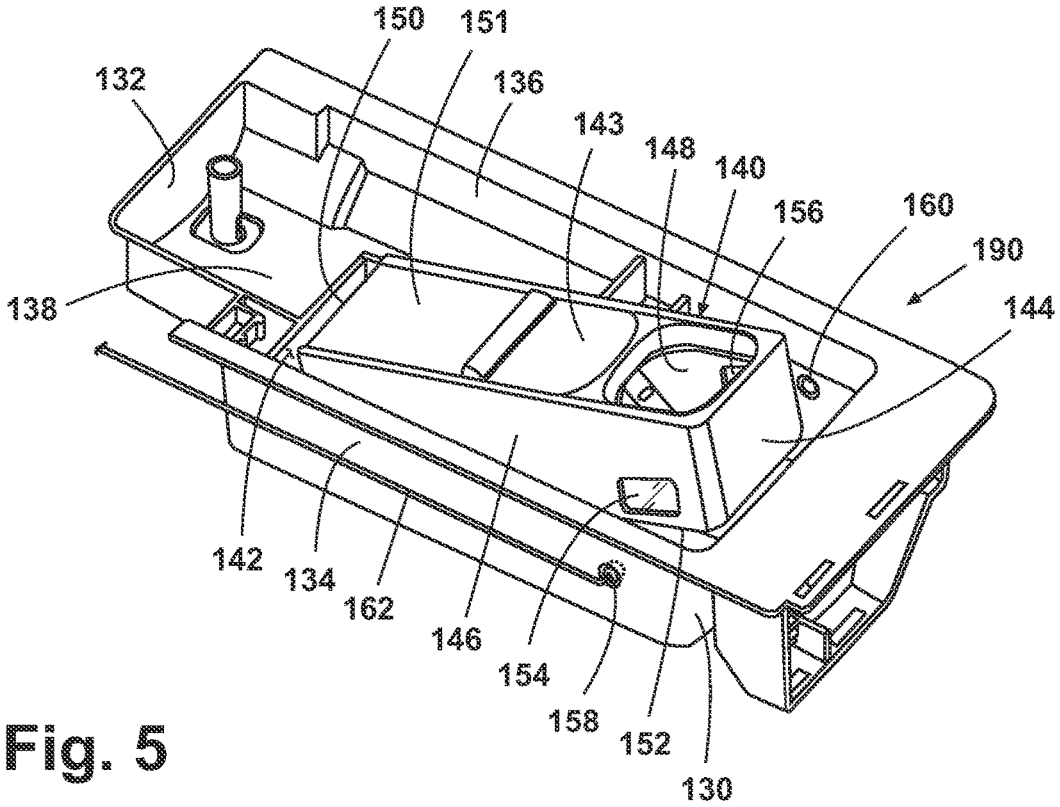
FIG. 5 is a perspective view of a second example of a wash aid dispenser drawer according to one embodiment of the invention, including at least one refractive index sensor assembly for sensing the concentration of a wash aid contained in a bulk dispenser cartridge.

FIG. 5 illustrates another example of a dispenser drawer 190 suitable for use with the automatic clothes washer 10. The dispenser drawer 190 may be configured for receipt of a bulk dispenser cartridge 140, also referred to as a "mini-bulk dispenser." An example of such a bulk dispenser cartridge is described and illustrated in concurrently-filed, commonly-owned U.S. patent application Ser. No. 12/165,712, filed Jul. 1, 2008, entitled "A Household Cleaning Appliance With A Dispensing System Operable Between A Single Use Dispensing System And A Bulk Dispensing System," now U.S. Pat. No. 8,196,441, issued Jun. 12, 2012, which is incorporated herein by reference in its entirety. The dispenser cartridge 140 contains a quantity of a laundering aid, such as a laundry detergent, sealed therein behind a slidable door 143 (shown open in FIG. 5) and sufficient for several laundering cycles, for example, 8-10 laundering cycles. The use of the dispenser cartridge 140 eliminates the need for a user to measure out a selected volume of laundering aid for each laundering cycle.

The dispenser cartridge 140 may be a generally rectilinear, box-like container sized to be received within a laundering aid compartment 142 of the dispenser drawer 190. The cartridge may have a front wall 144, a pair of parallel side walls 146, 148, a rear wall 150, a top wall 151 with the slidable door 143, and a bottom wall 152 defining a cartridge cavity in which the laundering aid may be contained. The slidable door 143 may be formed in the top wall 151, and provides for ready refilling of the cartridge 140. Each side wall 146, 148 may be provided with a sensor window 154, 156, respectively, the sensor windows 154, 156 being aligned for the transmission of a refractive index sensor light beam through the laundering aid.

Although the bulk dispenser cartridge has been described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

The dispenser drawer 190 may incorporate a transmitter 158 and a sensor 160 mounted therein for projection of a light beam from the transmitter 158 through the windows 154, 156 and the laundering aid, to be received by the sensor 160 for determining the refractive index of the laundering aid. The transmitter 158 may be electrically coupled with the controller 24 through a transmitter lead 162. The sensor 160 will be similarly coupled with the controller 24.

The dispenser drawer 190 may also be configured with a suitable fluid connector for connecting the dispenser cartridge 140 into a laundering aid dispensing line, such as the dispensing line 38 illustrated in FIGS. 1 and 2. The dispenser cartridge 140 may also be fluidly coupled with a valve for controlling the dispensing of laundering aid into the dispensing line, such as the valve 26 illustrated in FIGS. 1 and 2.

After the dispenser cartridge 140 has been properly installed in the dispenser drawer 190, a selected volume of laundering aid may be dispensed from the dispenser cartridge 140 through operation of the valve 26 under the control of the controller 24. This may be accomplished by the user selecting a volume of laundering aid on the user interface 22. Alternatively, this may be accomplished by selecting a laundering cycle on the user interface 22, which may then be processed by the controller 24, along with a determination of the size of the load, to automatically dispense the appropriate volume of laundering aid.

The use of the refractive index sensor assembly enables precise control of the volume of laundering aid dispensed. For example, if a selected laundering cycle and wash load size correspond with a predetermined volume of laundering aid having a selected concentration to provide optimal laundering, the refractive index sensor assembly may determine the concentration of the laundering aid, and the controller 24 may control the valve 26 to dispense the predetermined volume of laundering aid for the selected laundering cycle and wash load size. Alternatively, if the concentration of the laundering aid may be inputted by a user through the user interface 22 into the controller 24, the refractive index sensor assembly may confirm that the concentration of the laundering aid in the dispenser cartridge 140 is indeed the concentration entered by the user. If an adjustment in volume may be necessary to account for a difference in concentration from that input into the controller 24, the controller 24 may control the valve 26 to dispense the appropriate volume of laundering aid.

The refractive index sensor assembly may be used in a similar manner to control the volume of laundering aid dispensed from a large bulk laundering aid container (not shown). The bulk container may hold a quantity of laundering aid sufficient for a relatively large number of laundering cycles. The large container may not be utilized with a dispenser drawer, but may be fluidly coupled with the washing machine 10 through a dispenser fitting incorporated into the washing machine 10, in which the large container may be seated. The large container may be coupled with the washing machine 10 through a liquid-tight coupling (not shown), such as a quick-connect coupling assembly. The coupling may be fluidly connected to the valve 26, or to a dedicated dispensing valve (not shown) incorporated into the dispenser fitting.

As with the user-dispensed laundering aid described above, other remedial actions may be taken in response to a discrepancy in the actual concentration of the laundering aid versus a selected or expected concentration. These may include, for example, termination of the laundering cycle, adjustment of the volume of water utilized in the wash liquid, generation of audio or visual signals, dispensing of a suds reducer, and the like. Audio signals may include a tone, or a prerecorded message, such as "Add 3 milliliters of detergent." Visual signals may include a steady or blinking light, or a visual display on the user interface 22 which indicates the actual concentration of the laundering aid, or the volume of laundering aid to be added.

If the laundering cycle has proceeded with a wash liquid having a higher concentration of laundering aid than appropriate, rinse steps may proceed with additional rinse water, or additional rinse steps may be utilized in order to remove excess laundering aid that may be present in the laundered items. An extra spin step, or a higher speed spin step, may also be utilized between the wash step and rinse steps to assist in the removal of excess laundering aid. For example, the spin speed may be increased to 1000-1400 rpm from a normal spin speed of 700-800 rpm.

A refractive index sensor assembly may be utilized to determine the concentration of the undiluted laundering aid. This will lead to the most accurate control of the dispensing of the laundering aid and the selection of appropriate operational conditions. Alternatively, a refractive index sensor assembly associated with the sump 18 may be utilized in place of a dispenser refractive index sensor assembly, particularly where a bulk laundering aid dispenser may be utilized, since a bulk laundering aid dispenser may enable adjustments, particularly additions, to the quantity of laundering aid dispensed to be made after the initiation of the laundering cycle based upon the concentration determined from the sump refractive index sensor assembly. Alternatively, a sump refractive index sensor assembly may be utilized in combination with a dispenser refractive index sensor assembly to confirm that the concentration of laundering aid in the wash liquid may be appropriate. A sump refractive index sensor assembly may be somewhat less practicable, however, because the wash liquid in the sump will contain varying quantities of soil from the different laundering cycles and items being laundered, which will affect the accuracy of the concentration determination.

Figure 6:
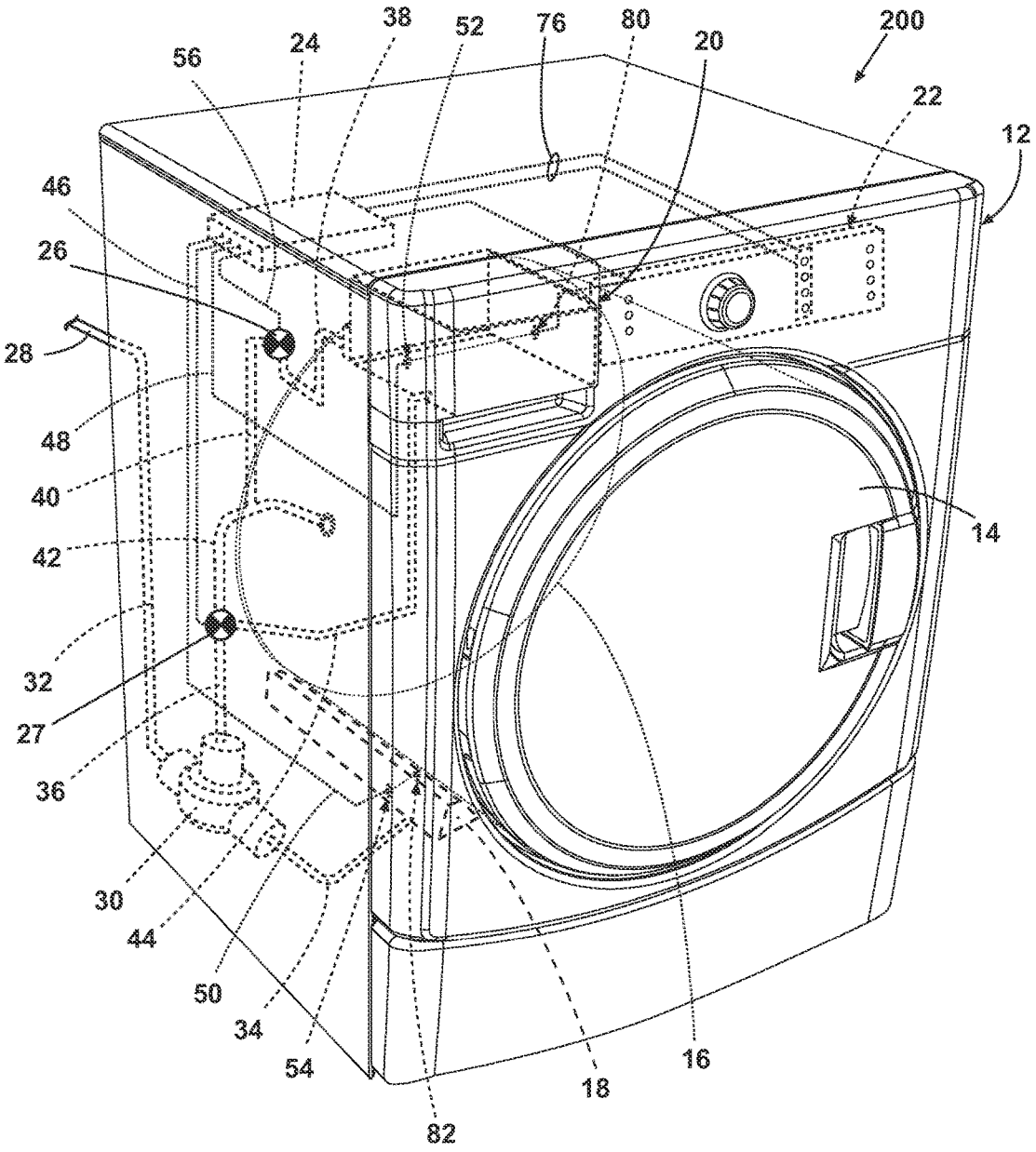
FIG. 6 is a perspective, partly schematic, view of another embodiment of the invention as an automatic clothes washing machine having a wash liquid concentration sensor, in the form of a refractive index sensor assembly, for determining the concentration of a wash aid in a wash liquid in a sump.
Figure 7:
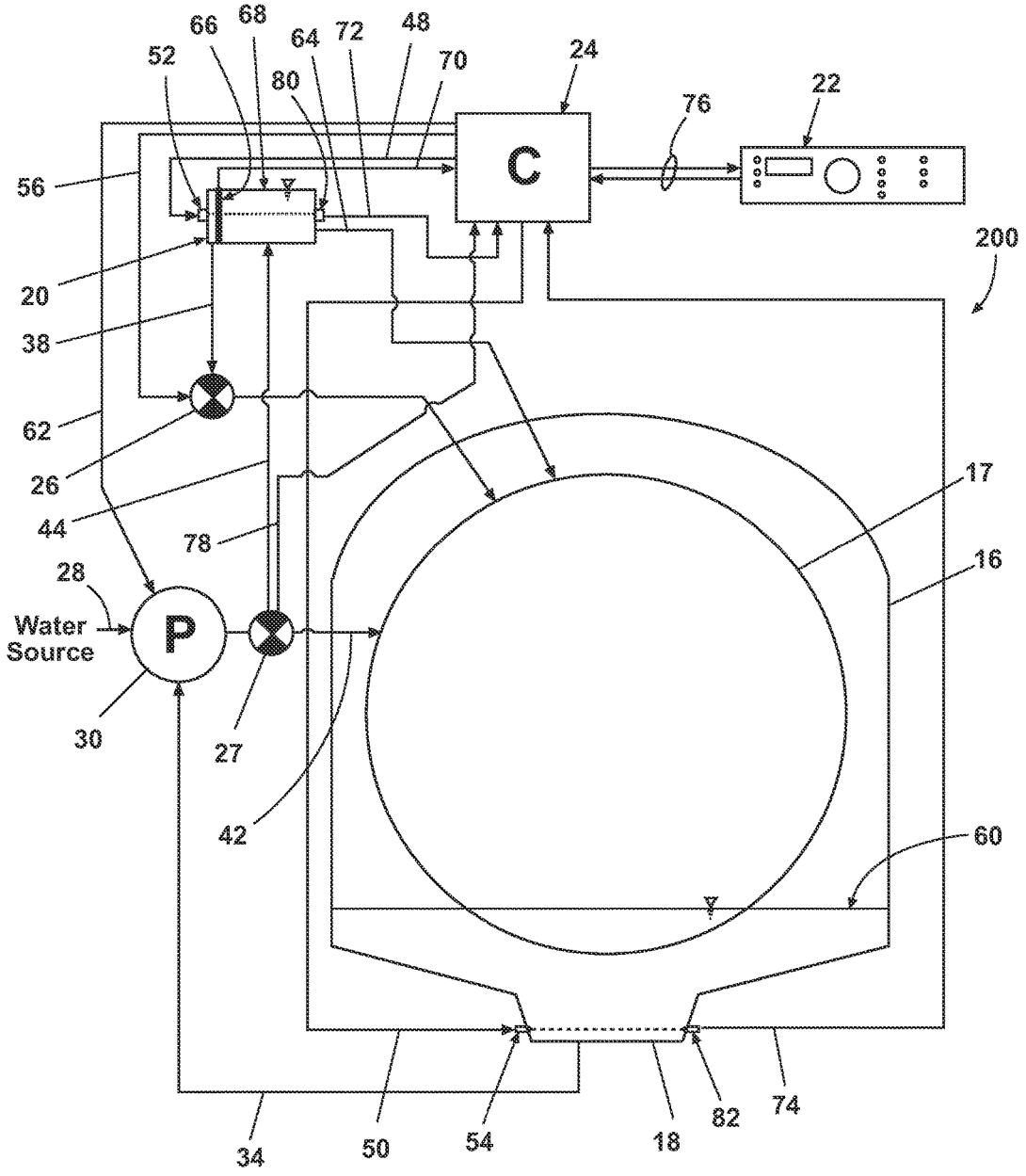
FIG. 7 is a schematic view of the automatic clothes washing machine illustrated in FIG. 6.

Another embodiment is illustrated in FIG. 6, which shows a washing machine 200 which shares many of the elements of the washing machine 10. Thus, like elements in both embodiments will be identified with like numbers. The sump 18 in the embodiment of FIG. 6 includes a refractive index sensor assembly having a transmitter 54 that may project a beam of light through the wash liquid in the sump 18 onto a sensor 82, which generates a signal which may be proportional to the concentration of laundering aid in the wash liquid in the sump 18. As illustrated in FIG. 7, the signal may be delivered through a sump sensor output lead 74 to the controller 24, which may control selected functionalities of the washing machine 200 based upon the concentration of the laundering aid in the wash liquid in the sump 18. The sump refractive index sensor assembly operates in generally the same manner as the previously-described refractive index sensor assembly associated with a dispenser drawer. FIGS. 6 and 7 illustrate a washing machine 200 having a sump refractive index sensor assembly with a dispenser refractive index sensor assembly. However, the washing machine 200 can be provided with the sump refractive index sensor assembly alone.

If the second laundering aid compartment 108 may be provided with a height transducer 124 (FIG. 4), the controller 24 may determine both the concentration of the detergent and the height (and thus the volume) of detergent in the laundering aid compartment 108. If the volume of a high concentration detergent may be too great for the selected laundering cycle and may result in excessive sudsing, for example, the controller 24 may control the volume of detergent dispensed from the dispenser drawer 20, instead of flushing all of the detergent from the dispenser drawer 20. The dispensing process may proceed by flushing a selected volume of detergent from the dispenser drawer 20, followed by a determination of the concentration of the detergent in the wash liquid in the sump 18. The controlled dispensing may also be accomplished by either dispensing a sufficient volume of water through the second compartment 108 to provide a wash liquid with an appropriate concentration of detergent based, for example, upon a sensed concentration of the detergent in the dispenser drawer 20, removing a selected volume of detergent from the second compartment 108 prior to adding the water, or dispensing a suds reducer, for example, from the third laundering aid compartment 110.

Other methodologies for controlling the flushing process by determining the concentration of the detergent in the wash liquid in the sump 18 may include multiple discrete flushing steps, with the concentration determined after each discrete flushing step, continuously flushing until the flushing may be halted based upon a determined concentration, flushing prior to the wash liquid reaching a desired volume, and adding water to the wash liquid to reach a selected volume without flushing additional laundering aid from the dispenser drawer 20, and flushing any remaining laundering aid from the dispenser drawer 20 after the completion of the selected laundering cycle.

If a low concentration detergent has been added instead of a higher concentration detergent, in a volume that may be too small for the selected laundering cycle, the controller 24 may control the volume of water added to the second compartment 108 to provide a wash liquid with an appropriate detergent concentration. If the resulting volume of wash liquid may be too small for the selected laundering cycle, the controller 24 may add a controlled volume of water in order to optimize the quantity of wash liquid with the detergent concentration, and may increase the duration of the laundering cycle to accommodate the lower concentration wash liquid and provide satisfactory laundering of the items.

Alternatively, if a low concentration detergent has been added, the thermal content, i.e. the temperature, of the wash load can be increased either by actuating a heater in the sump, or adding warm/hot water from the water supply 28. In one embodiment of the invention, the temperature can be increased 5-10° C. (9-18° F.) to ensure optimal performance with the lower detergent amount. Additionally, a message can be communicated to the user before this thermal option is implemented.

If the automatic clothes washing machine 10 is a "recirculating wash" machine, or if the washing machine 10 is selectively capable of both a "tumble wash" and a "recirculating wash," and a "recirculating wash" has been selected, an excessive quantity of laundering aid resulting from, for example, selection of a lower concentration laundering aid than actually provided may be remedied by the addition of water to the wash liquid, as previously described. Depending upon the resulting volume of wash liquid, the recirculating wash may be utilized as selected, or the laundering cycle may continue as a "tumble wash" in order to avoid the generation of excessive suds or damage to laundered items from the high concentration laundering aid.

Figure 8:
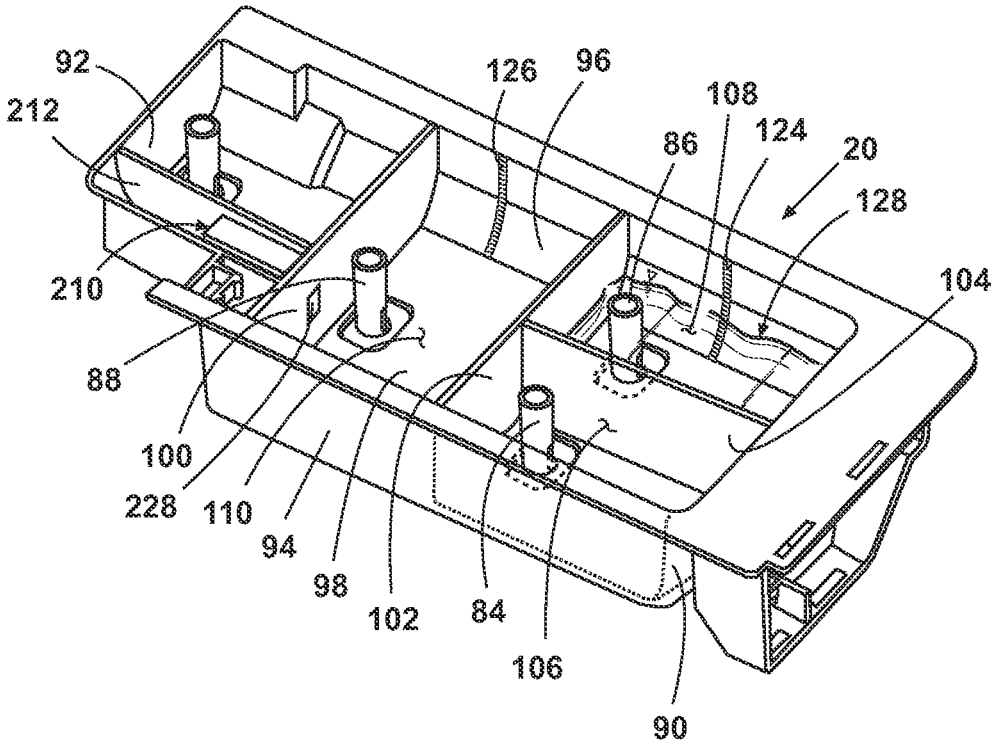
FIG. 8 is a perspective view of a wash aid dispenser drawer including an alternate refractive index sensor assembly according to one embodiment of the invention for sensing the concentration of a wash aid contained therein.

FIG. 8 illustrates an alternate embodiment of a refractive index sensor 210 for incorporation into a wash aid dispenser drawer 20. The dispenser drawer 20 may be provided with a sensor wall 212 in a laundering aid compartment to define a chamber in which the sensor 210 may be located. The wall 100 separating the chamber from the third laundering aid compartment 110 may be provided with a sensor opening 214.

Figure 9:
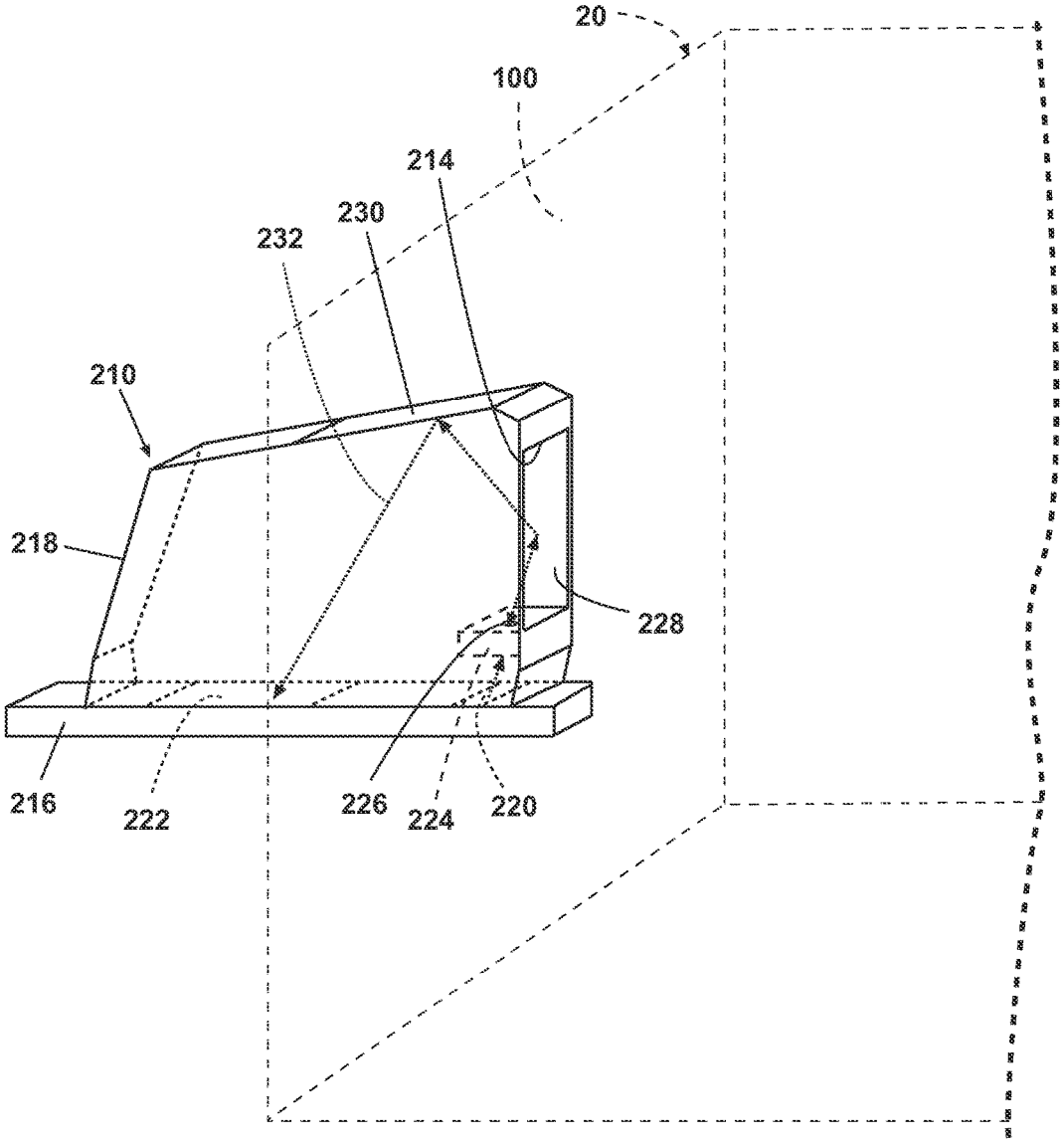
FIG. 9 is an enlarged, partially cutaway view of the wash aid dispenser drawer illustrated in FIG. 8 showing the refractive index sensor assembly.

Referring to FIG. 9, a suitable refractive index sensor 210 may be a Spreeta™-R sensor manufactured by Sensata Technologies of Attleboro, Mass. The sensor 210 includes a base 216 and a housing 218. The housing may be fabricated of a clear material, such as a plastic. The housing 218 includes a glass sensing interface 228 and a reflector 230. The base 216 includes a light source 220 and a photodiode array 222. The light source 220 may comprise one or more light emitting diodes (LEDs) configured to focus light at an angle onto the sensing interface 228. A focusing apparatus 224 may be positioned above the light source 220 and may comprise an aperture 226 for focusing a light beam 232 onto the sensing interface 228. The refractive index sensor 210 may be mounted in the wash aid dispenser drawer 20 so that the sensing interface 228 may be in registry with the sensor opening 214 and can contact the wash aid.

The sensor 210 is based on the optical phenomena of surface plasmon resonance, which occurs when light interacts with a free electron material. In operation, the light from the light source 220 reflects internally off the liquid-glass interface between the sensing interface 228 and the wash aid. The light then reflects off the mirror 230 and onto the photodiode array 222. Depending on the refractive index of the liquid, light striking the surface above a certain angle will be transmitted through the liquid-glass interface instead of being internally reflected. This angle is called the critical angle. This phenomenon results in a dark area or shadow-line on the photodiode array. The location of the shadow-line is indicative of the refractive index. As the refractive index changes, the critical angle also changes and is sensed as a new shadow-line location.

The refractive index sensor 210 can also be mounted in a similar manner in a reservoir downstream of and fluidly coupled with the dispenser drawer 20. In either case, the refractive index sensor 210 will be electrically coupled with the controller 24 so that the concentration of the wash aid determined by the refractive index sensor 210 may be utilized to control the wash cycle as hereinbefore described.

With this configuration, the sensing apparatus can be contained entirely on one side of the wash aid or laundering aid compartment. Additionally, only one window into the wash aid is required, and fewer electrical connections are required.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating an automatic washing machine in accordance with a selected wash cycle, the automatic washing machine comprising a wash chamber operable to receive fabric articles for washing, a wash aid dispenser fluidly coupled to the wash chamber, a sensor coupled with the at least one or more of the wash aid dispenser and a wash aid conduit and fluidly coupled therewith for sensing an estimated concentration of an undiluted wash aid disposed in at least one or more of the wash aid dispenser and wash aid conduit, a user interface for receiving a user input indicative of an undiluted wash aid concentration, and a water supply fluidly coupled to at least one of the wash aid dispenser and the wash chamber for generating wash liquid, the method comprising:

receiving, at the user interface, an input indicative of a concentration of the undiluted wash aid prior to combining the wash aid with a liquid;

automatically determining with the sensor an estimated concentration of an undiluted wash aid prior to combining the wash aid with a liquid; and automatically selecting an operating parameter of the automatic washing machine in response to one of the received input or the estimated concentration.

2. The method in accordance with claim 1 wherein selecting the operating parameter of the automatic washing machine comprises controlling a quantity of water introduced into the automatic washing machine based on one of the received input or estimated concentration.

3. The method in accordance with claim 2 wherein controlling the quantity of water introduced into the automatic washing machine comprises controlling a flushing of the wash aid from the wash aid dispenser.

4. The method in accordance with claim 3 wherein the flushing is controlled based on one of the received input or estimated concentration of a wash aid in the wash chamber.

5. The method in accordance with claim 2 wherein controlling the quantity of water introduced into the automatic washing machine comprises maintaining a generation of suds within the wash chamber below a preselected limit.

6. The method in accordance with claim 1 further comprising comparing the received input at the user interface with the determined estimated concentration.

7. The method in accordance with claim 6 wherein selecting the operating parameter further comprises selecting the operating parameter in response to at least one of the determined estimated concentration or the comparison of the received input with the determined estimated concentration.

8. The method in accordance with claim 6, further comprising confirming the received input based on the comparison of the received input with the determined estimated concentration.

9. The method in accordance with claim 8 wherein selecting the operating parameter further comprises selecting the operating parameter in response to confirmation of the received input.

10. The method in accordance with claim 8 wherein selecting the operating parameter of the automatic washing machine comprises controlling a quantity of water introduced into the automatic washing machine based on comparison of the received input with the determined estimated concentration.

11. The method in accordance with claim 8 wherein selecting the operating parameter of the automatic washing machine comprises including at least one of additional rinse steps, additional spin steps, or a higher spin speed when the comparison indicates the determined estimated concentration is higher than the received input.

12. The method in accordance with claim 1 wherein the undiluted wash aid comprises at least one of a detergent, a water softener, a fabric softener, an anti-sudsing agent, a fabric whitening agent, a fabric brightening agent, an in-wash stain remover, a color safe bleach, a peroxygen bleach, and a disinfectant.

13. The method in accordance with claim 1 further comprising determining a quantity of undiluted wash aid to be dispensed.

14. The method in accordance with claim 13 wherein determining the quantity of undiluted wash aid to be dispensed comprises sensing a height of the undiluted wash aid in one of the dispenser, a bulk dispensing container, and a measuring vessel.

15. The method in accordance with claim 13 wherein determining the quantity of undiluted wash aid to be dispensed comprises sensing a weight of the undiluted wash aid in one of the dispenser, a bulk dispensing container, and a measuring vessel.

16. The method in accordance with claim 1 further comprising determining a volume of undiluted wash aid to be dispensed.

17. A method for operating an automatic washing machine in accordance with a selected wash cycle, the automatic washing machine comprising a wash chamber and a wash aid dispenser fluidly coupled to the wash chamber, a sensor coupled with the at least one or more of the wash aid dispenser and a wash aid conduit and fluidly coupled therewith for sensing an estimated concentration of an undiluted wash aid disposed in at least one or more of the wash aid dispenser and wash aid conduit, a user interface for receiving a user input indicative of an undiluted wash aid concentration, and a water supply fluidly coupled to at least one of the wash aid dispenser and wash chamber for generating a wash liquid, the method comprising:

receiving an input indicative of a concentration of the undiluted wash aid by way of the user interface;

automatically determining with the sensor an estimated concentration of an undiluted wash aid prior to combining the wash aid with a liquid;

initiating a wash process;

selecting an operating parameter of the automatic washing machine in response to one of the received input or the estimated concentration;

initiating at least one rinse step after completion of the wash process; and initiating at least one spin process after completion of one of the wash process and at least one rinse step.

18. The method in accordance with claim 17, further comprising determining a quantity of undiluted wash aid to be dispensed.

19. The method in accordance with claim 18, wherein the determined quantity of undiluted wash aid to be dispensed is less than all of the undiluted wash aid.

* * * * *